US009255533B2

(12) United States Patent
Viehöver et al.

(10) Patent No.: US 9,255,533 B2
(45) Date of Patent: Feb. 9, 2016

(54) METHOD FOR CHECKING THE OUTGASSING OF FUEL AND CONTROL UNIT

(75) Inventors: Sebastian Viehöver, Regensburg (DE); Paul Rodatz, Landshut (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 834 days.

(21) Appl. No.: 13/576,897

(22) PCT Filed: Feb. 1, 2011

(86) PCT No.: PCT/EP2011/051394

§ 371 (c)(1), (2), (4) Date: Aug. 2, 2012

(87) PCT Pub. No.: WO2011/095479

PCT Pub. Date: Aug. 11, 2011

(65) Prior Publication Data

US 2012/0310514 A1 Dec. 6, 2012

(30) Foreign Application Priority Data

Feb. 2, 2010 (DE) ..... 10 2010 006 580

(51) Int. Cl.
*F01M 11/10* (2006.01)
*F02D 41/00* (2006.01)
(Continued)

(52) U.S. Cl.
CPC ..... *F02D 41/003* (2013.01); *F01M 13/00* (2013.01); *F02M 25/06* (2013.01); *F01M 2001/165* (2013.01); *F02D 41/1454* (2013.01);
(Continued)

(58) Field of Classification Search
CPC . F02D 41/042; F02D 41/047; F02D 2250/11; F02D 41/0032; F02M 25/06
USPC ..... 123/196 R, 196 A, 196 AB, 196 S, 698, 123/516, 572
See application file for complete search history.

(56) References Cited

U.S. PATENT DOCUMENTS 7,269,496 B2 * 9/2007 Honda et al. ..... 701/104
7,311,094 B2 12/2007 Mallebrein et al. ..... 123/698
(Continued)

FOREIGN PATENT DOCUMENTS

DE 10222808 A1 11/2003 ..... F02D 41/00
DE 102004008891 A1 9/2005 ..... F02D 19/12
(Continued)

OTHER PUBLICATIONS

German Office Action for Application No. 10 2010 006 580.3-26 (3 pages), Jul. 27, 2010.
(Continued)

*Primary Examiner* — Thomas Moulis
(74) *Attorney, Agent, or Firm* — Slayden Grubert Beard PLLC

(57) ABSTRACT

A control unit and a method for checking the outgassing of fuel from the lubricant of an internal combustion engine are provided, wherein, in a first method step, the outgassing of fuel from the lubricant is estimated on the basis of at least one operating parameter using a theoretical model during the normal operation of the internal combustion engine, and wherein, after the estimation of defined outgassing of fuel on the basis of the model, the outgassing of fuel is estimated in a second method step on the basis of at least one further operating parameter during a defined operating state.

20 Claims, 2 Drawing Sheets

(51) Int. Cl.

| | |
|---|---|
| ***F01M 13/00*** | (2006.01) |
| ***F02M 25/06*** | (2006.01) |
| *F01M 1/16* | (2006.01) |
| *F02D 41/14* | (2006.01) |

(52) U.S. Cl.
CPC ... *F02D2200/023* (2013.01); *F02D 2200/0406* (2013.01); *F02D 2200/703* (2013.01); *F02D 2250/11* (2013.01)

(56) References Cited

U.S. PATENT DOCUMENTS

| | | | | |
|---|---|---|---|---|
| 7,996,141 | B2 | 8/2011 | Pache et al. | 701/103 |
| 8,113,186 | B2 * | 2/2012 | Tsunooka et al. | 123/698 |
| 9,020,737 | B2 * | 4/2015 | Murase | 701/104 |
| 2004/0099252 | A1 * | 5/2004 | Nagaishi et al. | 123/480 |
| 2009/0211545 | A1 * | 8/2009 | Satou | F01M 13/0011 123/41.86 |
| 2010/0138086 | A1 * | 6/2010 | Imamura et al. | 701/22 |
| 2012/0109498 | A1 * | 5/2012 | Murase | F02D 41/0025 D41/25 |
| 2014/0046573 | A1 * | 2/2014 | Maemura | F02D 41/1495 701/102 |

FOREIGN PATENT DOCUMENTS

| | | | | |
|---|---|---|---|---|
| DE | 102006041686 | A1 | 11/2007 | F02D 41/06 |
| DE | 102007046489 | B3 | 5/2009 | F02D 45/00 |
| DE | 102010006580 | B3 | 7/2011 | F02D 41/00 |
| EP | 1944490 | A1 | 7/2008 | F02D 41/04 |
| FR | 2923266 | A1 | 5/2009 | F02D 41/00 |
| WO | 2011/095479 | A1 | 8/2011 | F01M 13/00 |

OTHER PUBLICATIONS

International Search Report and Written Opinion for Application No. PCT/EP2011/051394 (10 pages), Jun. 8, 2011.

* cited by examiner

METHOD FOR CHECKING THE OUTGASSING OF FUEL AND CONTROL UNIT

CROSS-REFERENCE TO RELATED APPLICATIONS

This application is a U.S. National Stage Application of International Application No. PCT/EP2011/051394 filed Feb. 1, 2011, which designates the United States of America, and claims priority to German Application No. 10 2010 006 580.3 filed Feb. 2, 2010, the contents of which are hereby incorporated by reference in their entirety.

TECHNICAL FIELD

This disclosure relates to a method and a control unit for checking outgassing.

BACKGROUND

Conventional methods for checking outgassing of fuel from engine oil of an internal combustion engine include that described in DE 10 2007 046 489 B3, which describes a method of this kind in which operating parameters of the internal combustion engine are detected, with a mass flow of fuel from the crankcase to the intake section being determined as a function of detected operating parameters. The internal combustion engine is controlled or monitored as a function of the mass flow of fuel from the crankcase to the intake section. Primarily, uncombusted fuel can be dissolved in a lubricant of the internal combustion engine immediately after a cold start of the internal combustion engine, said uncombusted fuel then evaporating again as the operating temperature rises. The dissolution of the fuel in the lubricant causes an undesired change in the lubricating properties of the lubricant. The fuel which is dissolved in the lubricant evaporates as the operating temperature rises, and collects primarily in the crankcase in a reciprocating-piston internal combustion engine. In order to prevent uncombusted fuel being emitted to the environment, the crankcase is connected to the intake section by means of a crankcase venting system. A mass flow from the crankcase to the intake section, which mass flow is dependent on the operating state of the internal combustion engine, is established on account of a pressure drop from the crankcase to the intake section. This mass flow comprises exhaust gas and air which are routed from the combustion chamber into the crankcase past the sealing rings of the pistons, and possibly fuel which is evaporated from the lubricant in the crankcase.

The control system of a modern internal combustion engine monitors the ability of the components of said internal combustion engine to function by means of diagnosis of the operating parameters which are available to said control system. Fuel which evaporates from the lubricant and is routed into the intake section via the crankcase venting system enriches the fuel/air mixture in the combustion chamber or chambers of the internal combustion engine. For complete combustion of the fuel and the atmospheric oxygen ($\lambda=1$), the control system of the internal combustion engine has to meter less fuel in comparison to the fresh air which is supplied to the internal combustion engine. A deviation of this kind is interpreted by the control system as a defect in the internal combustion engine, for example a fuel supply device, or in a $\lambda$ sensor. In order to prevent incorrect interpretation, the situation of an excessively low quantity of fuel which is to be metered to the internal combustion engine over a predetermined period of time after a cold start is usually not interpreted as a fault. As a result, diagnosis of a defect in the internal combustion engine is significantly limited. The limitation has particularly serious consequences if the internal combustion engine is always operated only for a short time, for example in city traffic.

SUMMARY

In one embodiment, a method is provided for checking the outgassing of fuel from a lubricant of an internal combustion engine, with an estimation as to whether outgassing of fuel from the lubricant has taken place being made on the basis of at least one operating parameter with the aid of a model during normal operation of the internal combustion engine in a first method step, with an estimation as to whether there is outgassing of fuel being made on the basis of at least one further operating parameter during a defined operating state, in which the outgassing of fuel can be estimated more accurately, in a following method step on the basis of the model after defined outgassing of fuel has been identified.

In a further embodiment, after identification of outgassing of fuel in a first method step, an intervention is made in normal operation of the internal combustion engine in order to adjust the defined operating state of the internal combustion engine in the following method step. In a further embodiment, the intervention involves closing a tank venting valve. In a further embodiment, the intervention involves making a request for a no-load phase during a stop in a start/stop function. In a further embodiment, a value of a lambda controller is used as the further operating parameter. In a further embodiment, the value of the lambda controller or an adaptation value of the lambda controller is used as the further operating parameter. In a further embodiment, the model is experimentally determined in the form of a function, and with a threshold value for the function being stored, and with the function depending on at least one of the following parameters: oil temperature, engine rotation speed, lambda value upstream of the catalytic converter, ambient pressure and intake pipe pressure. In a further embodiment, the entry of fuel into the lubricant is estimated with the aid of the model in a first method step and the outgassing of fuel being identified on the basis of the entry of fuel. In a further embodiment, the entry of fuel is estimated on the basis of the number of cold starts and/or the start temperature and/or a period of time over which the internal combustion engine has been operated with high load and high rotation speed and a rich mixture. In a further embodiment, an intervention is made in a fault diagnosis of the fuel system, in particular the fault diagnosis being interrupted, when a relevant instance of outgassing of fuel is identified on the basis of the further operating parameter.

In another embodiment, a control unit is designed to execute any of the methods disclosed above.

BRIEF DESCRIPTION OF THE DRAWINGS

Example embodiments will be explained in more detail below with reference to figures, in which.

DETAILED DESCRIPTION

Figure 1:
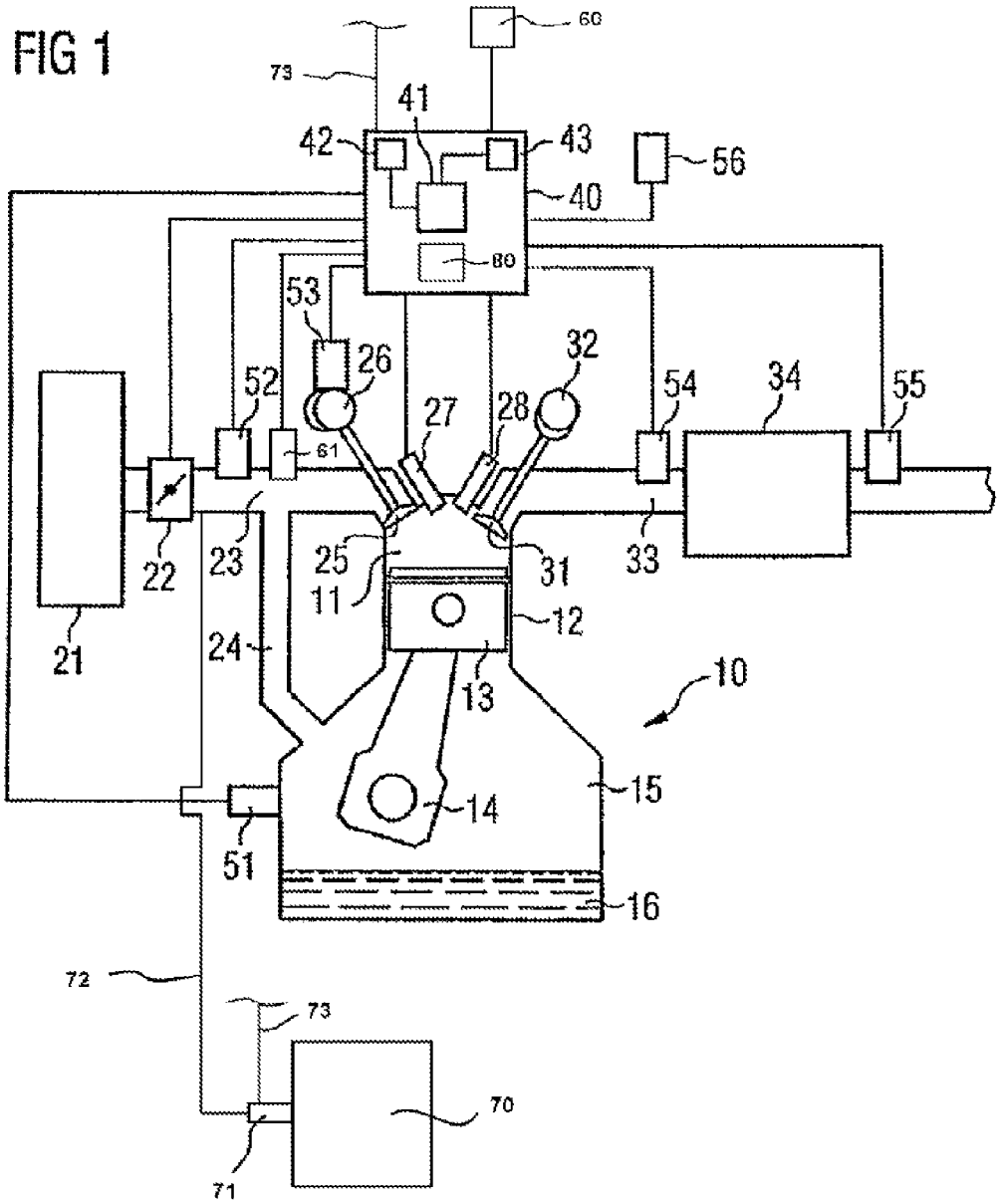
FIG. 1 shows a schematic illustration of an internal combustion engine.

Some embodiments provide an improved method and an improved control unit for checking the outgassing of fuel from a lubricant of an internal combustion engine.

Some embodiments of the disclosed method provide the advantage that outgassing of fuel can be checked and identified with a low level of expenditure. The relatively low level of expenditure is achieved by a check as to whether there are indications of the outgassing of fuel being made with the aid of a theoretical model in a first method step. If this is the case, a check as to whether there is outgassing of fuel is made on the basis of an operating parameter in a defined operating state of the internal combustion engine in a second method step. The probability of the outgassing of fuel being identified with a relatively low level of expenditure is increased by the two-stage method.

In one embodiment, an intervention in the operation of the internal combustion engine is made in order to adjust the defined operating state, in which the outgassing of fuel can be detected more accurately, in a second method step.

On account of the two-stage method, the second stage, in which an intervention in the operation of the internal combustion engine is made, is rarely carried out. Therefore, the internal combustion engine can be operated for a relatively long period of time during normal operation. However, on account of the theoretical model, it is additionally ensured that outgassing can be reliably identified.

In one embodiment, the intervention in the operation of the internal combustion engine involves a tank venting valve being closed. The outgassing of fuel can be checked with a greater degree of accuracy by closing the tank venting valve.

In a further embodiment, the intervention in the operation of the internal combustion engine involves a no-load phase being set. Outgassing of fuel can be detected more accurately during no-load operation.

In a further embodiment, a value of the λ controller is used as the operating parameter for detecting outgassing of fuel. By way of example, the absolute value of the λ controller or an adaptation value of the λ controller can be used in this case. The outgassing can be detected in a simple and precise manner with the aid of the value of the λ controller.

In a further embodiment, the theoretical model is represented in the form of a mathematical function which depends on at least one operating parameter of the internal combustion engine. In this case, a threshold value is provided, with outgassing of fuel being identified when the function exceeds the threshold value. It is possible to monitor an indication of the outgassing of fuel in a simple and reliable manner with the aid of the described model.

In a further embodiment, the theoretical model depends on at least one of the following parameters: oil temperature, engine rotation speed, λ value upstream of a catalytic converter, ambient pressure or intake pipe pressure. The outgassing of fuel can be identified in a reliable and precise manner with the aid of at least one of the described parameters or several of the described parameters.

In a further embodiment, a reference value is stored for a defined operating parameter and a defined test operating state. If the defined operating parameter exceeds the defined reference value in the test operating state, an indication of an instance of relevant outgassing of fuel is identified.

In a further embodiment, an intervention in a fault diagnosis of the fuel system is made, in particular the fault diagnosis is interrupted, when an instance of relevant outgassing of fuel is identified, that is to say when outgassing of fuel is identified with the second method step. The interruption can be performed, for example, for a defined period of time. Incorrect fault diagnoses which could be generated by outgassing of fuel are prevented with the aid of this measure.

In one embodiment of the method, the entry of fuel into the lubricant is estimated as an indication of outgassing of fuel with the aid of the model in a first method step. A high entry of fuel means a high probability of outgassing of fuel.

FIG. 1 shows a schematic illustration of an internal combustion engine 10 having a combustion chamber 11 in a cylinder 12. The combustion chamber 11 is closed off from a piston 13 on one side. The piston 13 is connected to a crankshaft (not illustrated) in a crankcase 15 by means of a connecting rod 14. The internal combustion engine 10, in particular the piston 13 moving in the cylinder 12, is lubricated with oil as the lubricant 16, said oil collecting in the crankcase 15 and being circulated and filtered by devices which are not illustrated.

The internal combustion engine 10 also has an air filter 21, a throttle valve 22, an intake section 23 and a venting system 24 of the crankcase 15 in the intake section 23. The intake section 23 is connected to the combustion chamber 11 via an inlet valve 25 which is controlled by means of a camshaft 26. A fuel injection valve 27 and a spark plug 28 are also provided on the combustion chamber 11 of the internal combustion engine. Alternatively, the fuel injection valve 27 can be arranged on the intake section 23 and therefore upstream of the inlet valve in the direction of flow, or can be replaced by a carburetor or another fuel supply device. The spark plug 28 can be dispensed with in the case of a diesel engine.

The combustion chamber 11 of the internal combustion engine 10 is also connected to an exhaust gas section 33 via an outlet valve 31 which is controlled by means of a camshaft 32. One or more catalytic converters 34 or other devices for filtering or treating exhaust gases from the internal combustion engine 10 can be arranged in the exhaust gas section 33.

The internal combustion engine 10 is coupled to a control system 40 which controls the internal combustion engine 10. The control system 40 comprises a processor 41 which is coupled to a program memory 42 and a value memory 43. The processor 41, the program memory 42 and the value memory 43 can each comprise one or more microelectronic components. As an alternative, the processor 41, the program memory 42 and the value memory 43 can be partially or fully integrated in a microelectronic component. The program memory 42 can contain a program in the form of software or firmware for controlling one of the methods described below.

The control system 40 is connected to a temperature sensor 51, an air mass meter 52, a rotation speed sensor 53, X sensors 54, 55, an ambient temperature sensor 56, the fuel injection valve 27, the spark plug 28 and optionally to further sensors or actuators and other devices of the internal combustion engine 10 via lines. The temperature sensor 51 is arranged on the internal combustion engine 10 such that it detects a relevant temperature. Arrangement in the coolant circuit, in the lubricant circuit or on the cylinder head is possible, for example. The air mass sensor 52 detects the mass flow of the fresh air flowing from the air filter 21, via the throttle valve 22, into the intake section 23. As an alternative, the air mass sensor 52 can be arranged, as seen in the direction of flow, upstream of the throttle valve 22 or else downstream of the mouth of the venting system 24 in the intake section 23.

A first pressure sensor 60 is also provided, said first pressure sensor detecting the ambient pressure. In addition, a second pressure sensor 61 is provided, said second pressure sensor detecting the pressure in the intake section 23. In this case, the fresh air mass flow can be calculated from the pressure and the rotation speed of the internal combustion engine or can be determined by means of a characteristic map. The rotation speed sensor 53 detects the rotation speed of the internal combustion engine and to this end is arranged, for example, on a camshaft 26 or on a flywheel of the internal combustion engine 10. The λ sensors 54, 55 are arranged, for example, upstream and, respectively, downstream of the catalytic converter 34 in the exhaust gas section 33. The ambient temperature sensor 56 is arranged, for example, such that it detects the temperature of the surrounding atmosphere in a manner not influenced by waste heat from the internal combustion engine as far as possible.

A fuel tank 70 is also provided, said fuel tank supplying the injection valve 27 with fuel. In addition, the tank 70 is connected to the intake section 23 via a tank venting valve 71 and a line 72. The tank venting valve 71 is additionally connected to the control system 40 via a control line 73.

Programs and values which allow operation of the internal combustion engine 10, in particular injection of fuel and combustion of fuel, in accordance with defined methods are stored in the program memory 42 and the value memory 43. In addition, programs and values with which it is possible to check the functioning of the internal combustion engine, in particular to check outgassing of fuel and to check for correct functioning of the fuel injection, are stored in the program memory and in the value memory.

In order to prevent outgassing of fuel from the fuel tank 70 to the environment, the fuel tank 70 is vented via the tank venting valve 71 and the line 72 into the intake section 23 during normal operation of the internal combustion engine, and therefore fuel vapors from the fuel tank 70 are also combusted by the internal combustion engine 10.

During operation of the internal combustion engine 10, the internal combustion engine 10 is supplied with a defined fuel/air ratio by the control system 40 in order to obtain a defined exhaust gas quality. The exhaust gas quality is detected with the aid of the first λ sensor 54 upstream of the catalytic converter 34 and the second λ sensor 55 downstream of the catalytic converter 34. In order to achieve the desired λ value, a λ controller 80 in the form of a program is used by the control system 40, said λ controller having a pilot control value for the quantity of fuel which is to be injected as a function of defined operating parameters of the internal combustion engine, in particular the rotation speed and the load, and an adaptation value for the quantity of fuel which is to be injected. The adaptation value is used in order to precisely match the λ value to a desired λ value. The adaptation value can, for example, compensate for aging phenomena of the fuel injection system or fluctuations in the functioning of the injection valves.

The value of the λ controller 80 and/or the adaptation value of the λ controller 80 is additionally used by a diagnosis method in order to check for correct functioning of the injection system, that is to say to check the supply of fuel to the internal combustion engine. To this end, the monitoring program detects the current value of the λ controller 80 and/or the adaptation value of the λ controller 80 and compares the detected values with defined reference values. If the comparison shows that the value of the λ controller and/or the adaptation value of the λ controller differ/differs from the defined reference values by more than a defined difference, a malfunction in the fuel supply is identified.

The value of the λ controller and the adaptation value of the λ controller depend on whether outgassing of fuel from the lubricant, that is to say the engine oil of the internal combustion engine, takes place. If a large amount of fuel evaporates, the first λ probe 54 identifies an excessively rich mixture, and therefore the injected quantity of fuel is reduced and therefore the λ controller and the adaptation value of the λ controller are adapted. Therefore, despite correct functioning of the injection system, the fault diagnosis 81 of the fuel system could arrive at the result that the value of the λ controller and/or the adaptation value of the λ controller differs greatly from the defined reference values and therefore there is a malfunction in the fuel supply.

In order to prevent incorrect fault diagnosis, it is possible to take account of whether relevant outgassing of fuel takes place. Relevant outgassing of fuel can be detected in a reliable and precise manner with the aid of the λ controller and/or the adaptation value of the λ controller in defined operating states of the internal combustion engine, for example when closing the tank venting valve 71 or in the case of no-load operation of the internal combustion engine. However, intervention in the normal operation of the internal combustion engine is required for this purpose since a defined operating state of the internal combustion engine, that is to say a test operating state, has to be set.

Figure 2:
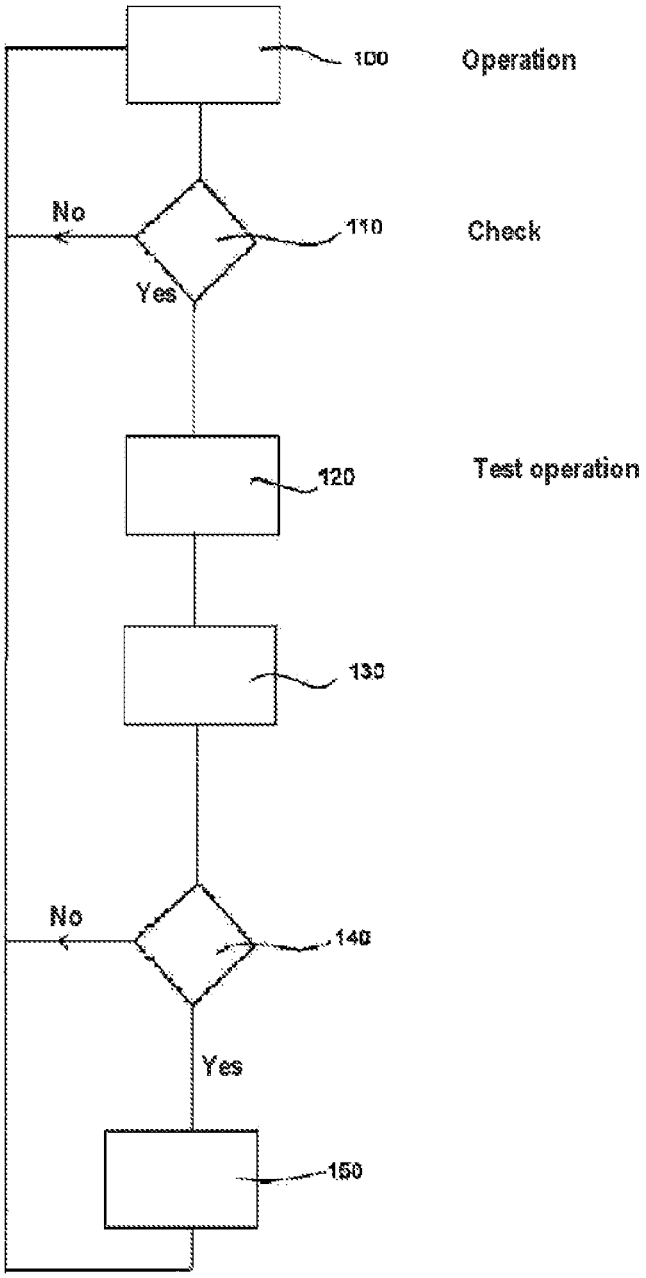
FIG. 2 shows a graph of the profile with respect to time of a theoretical model.

In order to improve the method for checking outgassing of fuel from lubricant, for example engine oil, of the internal combustion engine, a two-stage method is now proposed, said method being explained with reference to the program sequence of FIG. 2. In a first method step 100, an estimation as to whether outgassing of fuel from the engine oil could take place is made by the control system 40 during normal operation of the internal combustion engine 10 with the aid of a model. The model is stored, for example, in the form of a function which depends on at least one or more of the following parameters: oil temperature, engine rotation speed, λ value upstream of the catalytic converter, ambient pressure or intake pipe pressure. The model is determined experimentally and a reference value is stored, said reference value, in comparison to the model, defining whether outgassing of fuel takes place.

Various models can be used to estimate whether outgassing of fuel takes place. A simple approach involves drawing a conclusion about outgassing of fuel as a function of the entry of fuel into the engine oil. The entry of fuel can be determined as a function of various parameters. For example, the number of cold starts can be used to estimate the entry of fuel. Furthermore, the start temperature each time the internal combustion engine is started can be taken into account in order to estimate the entry of fuel. In this case, the number of starts of the internal combustion engine can be weighted with the respective start temperature in order to estimate the probability of the outgassing of fuel. Furthermore, the entry of fuel can also be estimated by detecting specific operating phases of the internal combustion engine, for example the period of time over which the internal combustion engine is operated at high load and high rotation speed with a rich mixture. On the basis of the described parameters, it is possible to establish whether the entry of fuel is greater than the threshold value by simple comparison, for example with a threshold value which was experimentally determined. If the estimated entry of fuel is greater than the threshold value, outgassing of fuel is identified.

Simple estimation of the entry of fuel can involve a sum of the number of starts of the internal combustion engine weighted with the start temperature being formed and being compared with a threshold value. In addition, threshold values for identifying a high load and identifying a high rotation speed and identifying a rich mixture are stored.

In a simple embodiment, only the period of time of operation of the internal combustion engine over which both the defined threshold value for the high load, the defined threshold value for the high rotation speed and the defined threshold value for a rich mixture are exceeded is detected. If the detected period of time at high load, high rotation speed and rich mixture is greater than a defined threshold value, a high entry of fuel and therefore outgassing of fuel is identified.

In a second method step 110, the control system checks whether the function exceeds the reference value.

If the check in the second method step 110 now shows that there is the probability of the outgassing of fuel, an intervention in the internal combustion engine is made in a following third method step 120 or there is a waiting period until the internal combustion engine is in a defined operating state, that is to say in a test operating state.

If the interrogation in the second method step 110 shows that there is no indication of relevant outgassing of fuel from the lubricant 16, the method returns to program point 100.

In the event of intervention in the operation of the internal combustion engine, the internal combustion engine 10 is operated by the control system 40 in such a way that there is a test operating state. The test operating state can involve, for example, closing the tank venting valve. A further test operating state of the internal combustion engine can constitute a no-load phase.

The no-load phase can be activated, for example, in an internal combustion engine with a start/stop functionality during customary stopping of the internal combustion engine.

During the test operating state, the control system 40 detects at least one operating parameter of the internal combustion engine in a following fourth method step 130 in order to check for relevant outgassing of fuel from the engine oil. In this case, the value of the λ controller 80 and/or the adaptation value of the λ controller 80 can be used in particular. Other operating parameters can also be used depending on the embodiment used. A defined reference value which clearly represents relevant outgassing of fuel when it is exceeded may be stored for a defined operating parameter and a defined test operating state. In a following fifth method step 140, the control system 40 detects the value of the defined operating parameter and compares the value with the reference value. If the comparison shows that the value of the defined operating parameter is below the reference value, no outgassing of fuel is identified and the method returns to the first method step 100. If the value of the defined operating parameter is above the reference value, outgassing of fuel is identified.

If outgassing of fuel is identified in a fifth method step 140, the method continues to a sixth method step. In the sixth method step 150, an intervention can be made in the fault diagnosis of the fuel system. In this case, it is possible, in particular, to not take into account the fault diagnosis and/or to not carry out the fault diagnosis for a defined period of time. Therefore, an incorrect fault diagnosis which is caused by outgassing of fuel can be achieved using simple means and with few adverse effects on the functioning of the internal combustion engine. The method then returns to the first method step 100.

Instead of a function for the theoretical model, a multidimensional characteristic map can also be used. The λ controller 80 is in the form of a control method which detects the signal of the first λ probe and, as a function of the detected λ signal, adapts the quantity of fuel which is injected into the internal combustion engine by the control system 40 via the injection valve 27. If the λ value which is detected by the first λ probe differs from the desired λ value, the value of the λ controller, that is to say the value for the quantity of fuel which is to be injected, is adapted in such a way that the fuel/oxygen ratio in the exhaust gas is brought into line with the desired λ value.

What is claimed is:

1. A method for checking the outgassing of fuel from a lubricant of an internal combustion engine, comprising:

using a model to perform a first estimation of outgassing of fuel from the lubricant based on at least one operating parameter during a normal operation of the internal combustion engine, after the first estimation of outgassing of fuel, using the model to perform a second estimation of outgassing of fuel based on at least one further operating parameter during a subsequent defined operating state, the subsequent defined operating state including a no-load phase.

2. The method of claim 1, further comprising, in response to the first estimation of outgassing of fuel, performing an intervention during the normal operation of the internal combustion engine to adjust the subsequent defined operating state of the internal combustion engine.

3. The method of claim 2, wherein the intervention involves closing a tank venting valve.

4. The method of claim 2, wherein the intervention involves making a request for a no-load phase during a stop in a start/stop function.

5. The method of claim 1, wherein the at least one further operating parameter comprises a value of a lambda controller.

6. The method of claim 1, wherein the at least one further operating parameter comprises a value of a lambda controller or an adaptation value of the lambda controller.

7. The method of claim 1, wherein the model is experimentally determined in the form of a function, and wherein a threshold value for the function is stored, and wherein the function depends on at least one of the following parameters: oil temperature, engine rotation speed, lambda value upstream of the catalytic converter, ambient pressure, and intake pipe pressure.

8. The method of claim 1, wherein the first estimation of outgassing comprises estimating the entry of fuel into the lubricant and identifying outgassing of fuel based on the entry of fuel.

9. The method of claim 8, wherein the entry of fuel is estimated based on at least one of a number of cold starts, a start temperature, and a period of time over which the internal combustion engine has been operated with high load and high rotation speed and a rich mixture.

10. The method of claim 1, comprising interrupting a fault diagnosis of the fuel system in response to identifying a relevant instance of outgassing of fuel based on the at least one further operating parameter.

11. A control unit configured to:

apply a model to perform a first estimation of outgassing of fuel from the lubricant based on at least one operating parameter during a normal operation of the internal combustion engine, and after the first estimation of outgassing of fuel, apply the model to perform a second estimation of outgassing of fuel based on at least one further operating parameter during a subsequent defined operating state, the subsequent defined operating state including a no-load phase.

12. The control unit of claim 11, wherein the control unit is further configured to, in response to the first estimation of outgassing of fuel, perform an intervention during the normal operation of the internal combustion engine to adjust the subsequent defined operating state of the internal combustion engine.

13. The control unit of claim 12, wherein the intervention involves closing a tank venting valve.

14. The control unit of claim 12, wherein the intervention involves making a request for a no-load phase during a stop in a start/stop function.

15. The control unit of claim 11, wherein the at least one further operating parameter comprises a value of a lambda controller.

16. The control unit of claim 11, wherein the at least one further operating parameter comprises a value of a lambda controller or an adaptation value of the lambda controller.

17. The control unit of claim 11, wherein the model is experimentally determined in the form of a function, and wherein a threshold value for the function is stored, and wherein the function depends on at least one of the following parameters: oil temperature, engine rotation speed, lambda value upstream of the catalytic converter, ambient pressure, and intake pipe pressure.

18. The control unit of claim 11, wherein the first estimation of outgassing comprises estimating the entry of fuel into the lubricant and identifying outgassing of fuel based on the entry of fuel.

19. The control unit of claim 18, wherein the entry of fuel is estimated based on at least one of a number of cold starts, a start temperature, and a period of time over which the internal combustion engine has been operated with high load and high rotation speed and a rich mixture.

20. The control unit of claim 11, wherein the control unit is further configured to interrupt a fault diagnosis of the fuel system in response to identifying a relevant instance of outgassing of fuel based on the at least one further operating parameter.

* * * * *